United States Patent [19]

Erickson et al.

[11] 4,236,454

[45] Dec. 2, 1980

[54] MOUNTAIN MONORAIL SLIDE

[76] Inventors: Alve J. Erickson, 17 Pleasant St., Milford, N.H. 03055; Robert D. Thulman, 10596 E-1 Twin Rivers Rd., Columbia, Md. 21044

[21] Appl. No.: 884,963

[22] Filed: Mar. 9, 1978

[51] Int. Cl.[3] ..... A63G 21/04

[52] U.S. Cl. ..... 104/69; 104/119; 104/120; 104/246; 104/249; 105/145; 188/43

[58] Field of Search ..... 104/120, 118, 119, 69, 104/63, 64, 56, 53, 113, 246, 249, 250, 126; 105/145, 144, 141; 272/34, 35; 188/43, 184, 185, 72.6, 72.9; 280/95 R, 88; 295/1

[56] References Cited

U.S. PATENT DOCUMENTS

| | | | |
|---|---|---|---|
| 30,006 | 9/1860 | Stewart | 188/43 |
| 775,702 | 11/1904 | DeBaun | 104/145 X |
| 1,281,119 | 10/1918 | Barraclough | 104/250 UX |
| 1,852,384 | 4/1932 | Wallin | 104/69 |
| 2,731,922 | 1/1956 | Robb | 104/120 X |
| 2,990,788 | 7/1961 | Wallace | 104/126 |
| 3,114,332 | 12/1963 | Bacon et al. | 104/63 |
| 3,319,581 | 5/1967 | Churchman et al. | 104/119 X |
| 3,447,481 | 6/1969 | Gorham | 104/120 |
| 3,576,242 | 4/1971 | Mumma | 188/185 X |
| 3,672,308 | 6/1972 | Segar | 104/246 |
| 3,677,188 | 7/1972 | Bordes | 104/120 |
| 3,720,423 | 3/1973 | Morris | 280/88 |
| 3,841,223 | 10/1974 | Bertin | 104/120 X |
| 4,022,133 | 5/1977 | Lindblom et al. | 295/1 X |

FOREIGN PATENT DOCUMENTS

| | | | |
|---|---|---|---|
| 549695 | 1/1957 | Belgium | 104/120 |
| 409292 | 4/1934 | United Kingdom | 188/185 |

*Primary Examiner*—Randolph A. Reese

*Attorney, Agent, or Firm*—Schwartz, Jeffery, Schwaab, Mack, Blumenthal & Koch

[57] ABSTRACT

A guideway gravity vehicle combination designed for recreational use on hills and mountains consisting of a wheeled, stabilized vehicle riding on a monorail which extends from the top to the bottom of a downwardly inclined slope. The rider controls the vehicle speed through the use of powerful braking systems. Maximum speeds are regulated by automatic braking.

11 Claims, 14 Drawing Figures

FIG. 6
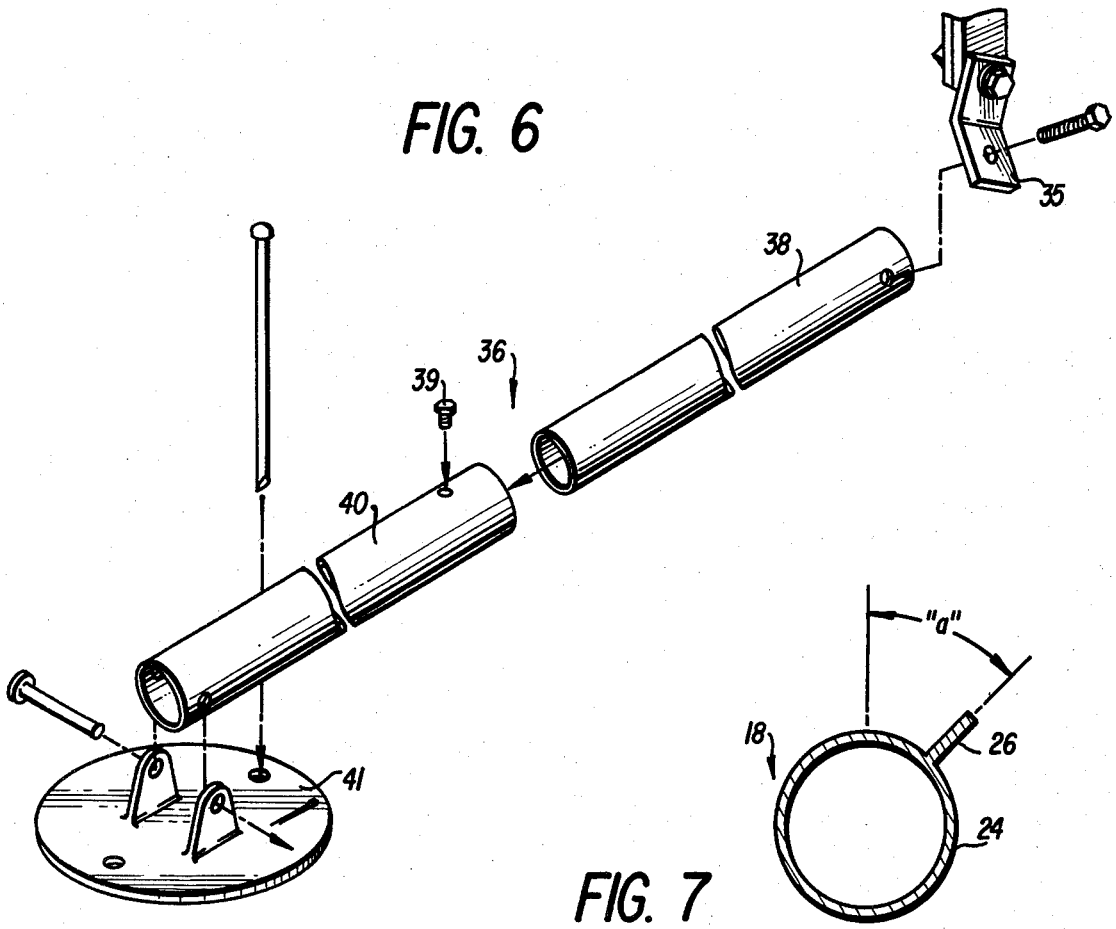
FIG. 7
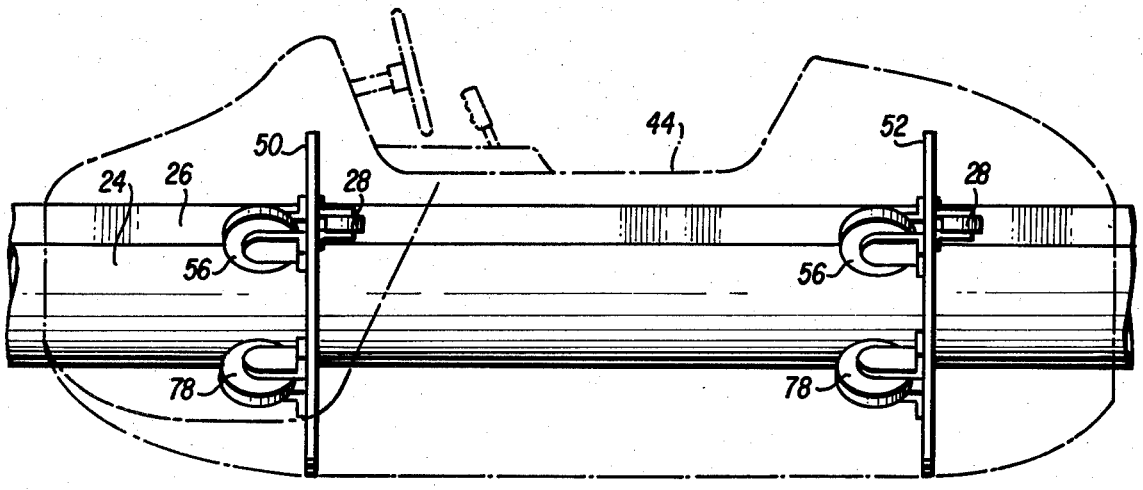
FIG. 8

MOUNTAIN MONORAIL SLIDE

BACKGROUND OF THE INVENTION

In order to extend the business season at ski resorts, a number of operators have installed downhill slides to attract summer patronage. Examples of slides and associated sleds are shown in U.S. Pat. Nos. 3,858,517 and 3,973,785. In operation sleds and riders are carried up the mountain on the ski lift. The sled and rider, who controls the sled speed, then proceed down the slide which begins near the upper lift station and terminates at the lower station. The slide may extend laterally quite far from the lift and thus can be considerably longer than the lift.

Many of these slide installations have become very popular. However, several disadvantages and limitations have become obvious in existing slides. It is possible for the sled to leave the track and thus injure the rider and damage the sled. The braking systems are limited by the slide materials and the constraints of the sled-slide brake system. Braking in general is not good and under wet conditions is completely inadequate. In many installations as soon as rain begins all sleds must be stopped and removed from the slide wherever they are along the incline and the rider has to walk down the hill. Another disadvantage of current designs is that the cost of the track is high because the materials are expensive and the track must be carefully supported at short intervals along the hill. Maintenance of the track is necessary because of damage done to the track by the sled. The quality of the ride is less than desired due to joint irregularities in the track and no softening of the suspension is incorporated in the sled. Finally, toxicity of some of the current slide materials (usually containing asbestos) is unknown at this time, but is suspected to cause cancer if present in water or air environments.

OBJECTS OF THE INVENTION

It is an object of the present invention to provide a mountain slide in which the slide vehicle travels on a single continuous track (monorail).

It is another object of the present invention to provide a mountain slide which provides a faster ride than prior slides.

It is yet another object of the present invention to provide a mountain slide which is safer than prior slides.

Yet another object of the present invention is to provide a mountain slide which does not require continuous maintenance of the slide track.

Another object of the present invention is to provide a mountain slide in which the braking action of passenger controlled brakes is not limited by the weight of the vehicle.

A further object of the present invention is to provide a mountain slide in which the maximum speed of the vehicle is automatically controlled.

Another object of the present invention is to provide a mountain slide which is less expensive to install than prior slides.

A further object of the present invention is to provide a mountain slide which is readily adaptable to variable terrain.

It is also an object of the present invention to provide a mountain slide in which the slide vehicles cannot jump the track.

Another object of the present invention is to provide a mountain slide with a smooth stable ride.

Another object of the present invention is to provide a mountain slide in which movement of a vehicle along the slide can be restrained by remotely operable means.

A further object of the invention is to provide a mountain slide which can be used even in damp weather.

Another object of the invention is to provide a mountain slide which can be installed on nonlevel terrain with a minimum of alteration to the terrain.

SUMMARY OF THE INVENTION

These and other objects of the invention are achieved by providing an amusement ride comprising a continuous monorail track adapted to be disposed on nonlevel terrain to form a descending tortuous path, means for supporting said track in spaced relation to the underlying terrain, guide means on said track for controlling the movement of a vehicle along said track, and at least one vehicle adapted to run on said track, said vehicle comprising a passenger carrying space, wheel means for supporting said vehicle on said track, means on said vehicle for engaging said guide means on said track, means for positively retaining said vehicle on said track and passenger controlled brake means for selectively gripping opposite sides of a portion of said track between a movable brake shoe and a cooperating member whereby to control the speed of said vehicle along said track.

BRIEF DESCRIPTION OF THE DRAWINGS

The invention will be described with reference to the following drawings wherein

FIG. 6 is an exploded detailed view of a telescoping support member for the monorail track.

FIG. 7 is a sectional view of a curved section of the track showing displacement of the guide rib.

FIG. 8 is a cutaway elevation of a vehicle used in the present invention.

DETAILED DESCRIPTION OF THE PREFERRED EMBODIMENT

Figure 1:
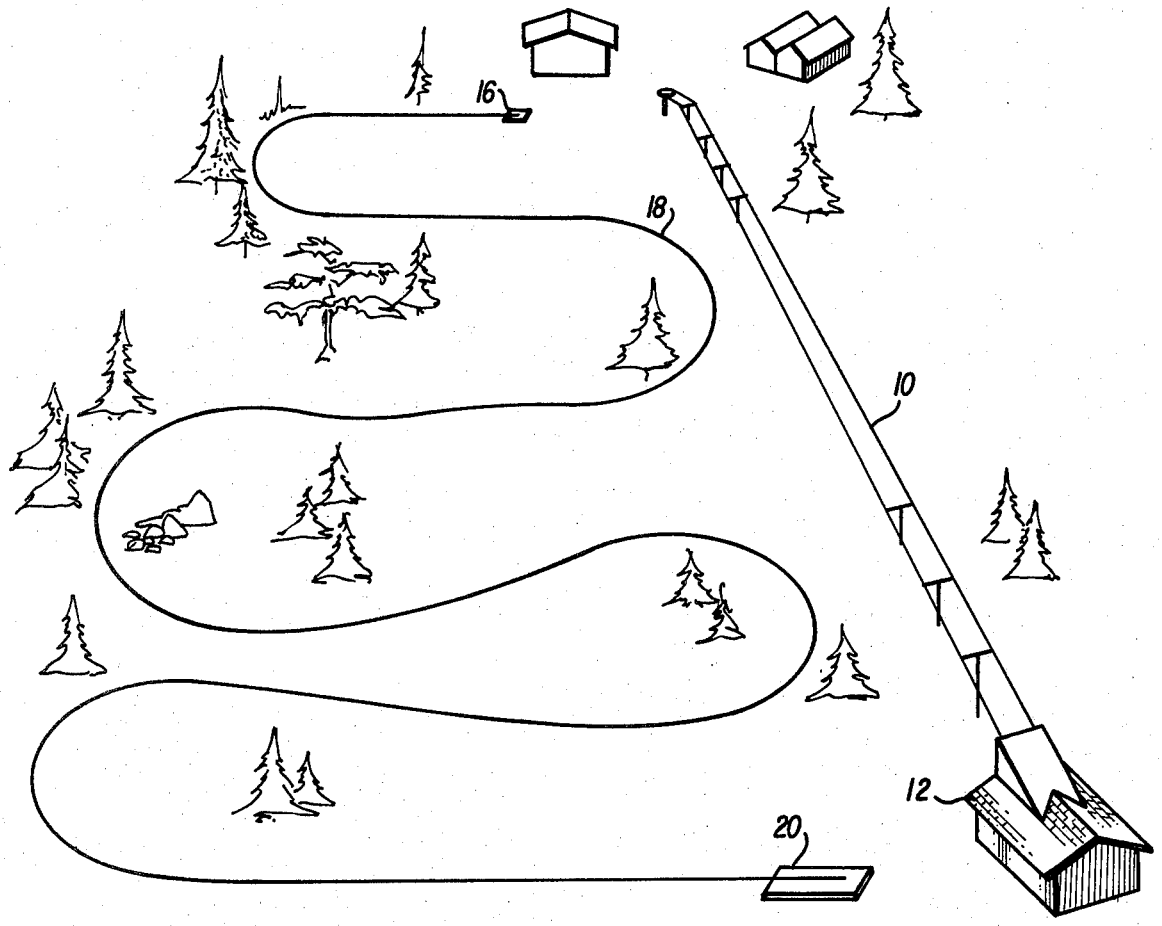
FIG. 1 is a schematic, perspective view of a ski resort area at which the invention is installed.

FIG. 1 shows a mountain slope with a lift 10 operating from the lower base station 12 to the top station 14. Such lifts typically have a vertical drop from 500 to 2000 feet. Conveniently near the upper terminal of the lift is the loading platform 16 for the guideway system.

The heart of the guideway is a monorail track 18. Monorail track 18 extends along a tortuous path diagonally back and forth across the mountain slope and terminates at the unloading platform 20 which is near the lift base station 12. The length of the monorail track is typically 5 to 15 times as long as the mountain vertical drop. At the lift base station 12, the cars 22 can be attached to the lift 10 and thus be carried up the mountain with the riders.

The monorail track 18 is constructed using convenient lengths of straight and curved sections which are attached to each other. The curved sections may be curved in horizontal and/or vertical planes.

Many shapes are available for the monorail cross-section. Desirable features for the cross-sectional shape are (a) horizontal and vertical stiffness and strength, (b) low cost, (c) can be bent horizontally and vertically using simple equipment and with minimum out-of-plane distortion and (d) the top of the rail should be generally convex upwards so as to reduce the possibility of rocks or other items remaining on the track.

Figure 2:
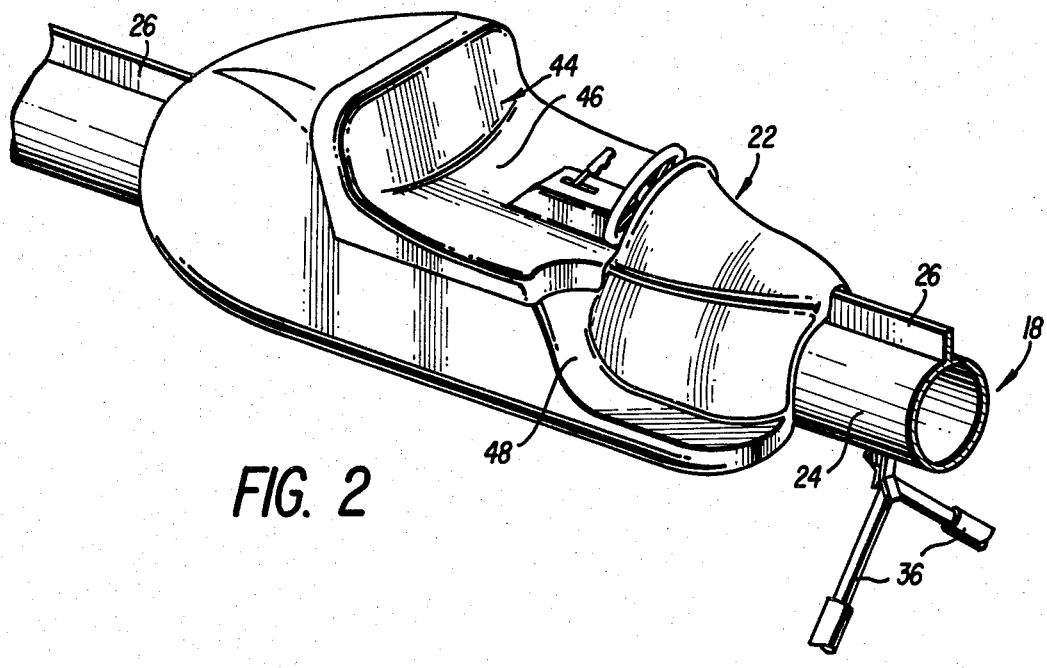
FIG. 2 is a perspective view of a vehicle on a section of the monorail track.
Figure 3:
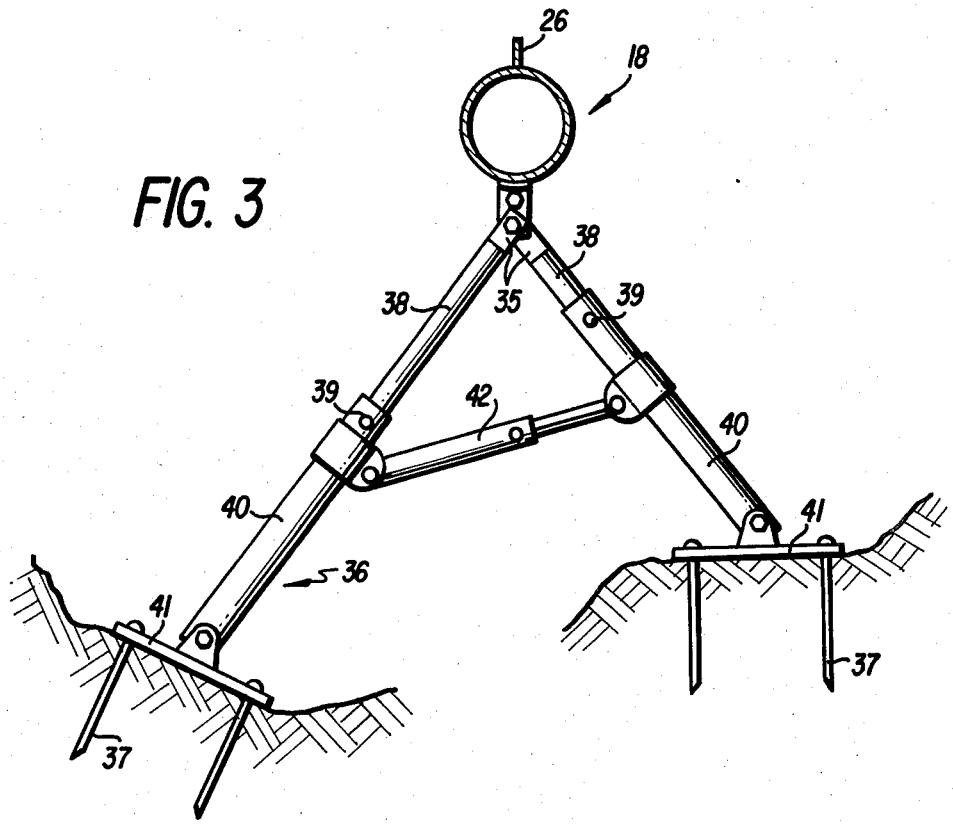
FIG. 3 is a vertical plan view showing the support means for the monorail track.

A preferred cross-sectional shape of the monorail track 18 is shown in FIGS. 2 and 3. The basic structural element is a cylindrical tube 24 which possesses a high vertical, horizontal and torsional stiffness for a specified amount of material. Ten foot lengths of standard four-inch steel pipe ($4\frac{1}{2}$ inch outside diameter; $\frac{1}{4}$ inch wall thickness) are well suited for use as rail sections. Use of such standard components makes possible economical construction of the track. Tube 24 can conveniently be bent horizontally so as to put curves in the track and vertically in order to match the slope of the hill. Standard curves or "transition" sections can also be used between straight sections in order to fit the track conveniently to any hill. Attached to the circular tube 24 is a small continuous rectangular section or rib 26. The purposes of rib 26 are threefold: (i) since the center of gravity of the car 22 plus the rider is above the center of support (the tube center), the car is not rotationally stable and must be stabilized. This is accomplished using guide wheels 28 on both sides of the rib or strip 26. Details of the rotational stabilization are discussed in a later section; (ii) when the car 22 and rider go around a curve, centrifugal force pushes towards the outside of the curve. This force can be balanced using gravity by banking the car towards the inside of the curve. A banking angle can be imposed on car 22 with its rider by displacing the rib angularly as shown by FIG. 7. The angle of displacement "a" depends on the speed of the vehicle and the radius of the curve and can be computed according to well known physical laws; rib 26 can be used for very effective braking by having brake pads 30 on both sides of the rib. The brake pads 30 are then pinched together and the rib acts like a brake disc. The rib 26 may suitably be made from standard steel strip $\frac{1}{4}''$ to $\frac{3}{8}''$ thick and $1\frac{1}{2}''$ to $2''$ wide although other sizes may also be used. Desirably the rib is welded to the top of the tubular track after the tubular sections have been assembled on the hillside. This procedure simplifies the alignment and assembly of the tubular portion of the track and also facilitates proper orientation of the guide rib 26. Welding the rib to the assembled tubular sections also enables proper banking of the vehicles as they traverse curved portions of the track.

Figure 4:
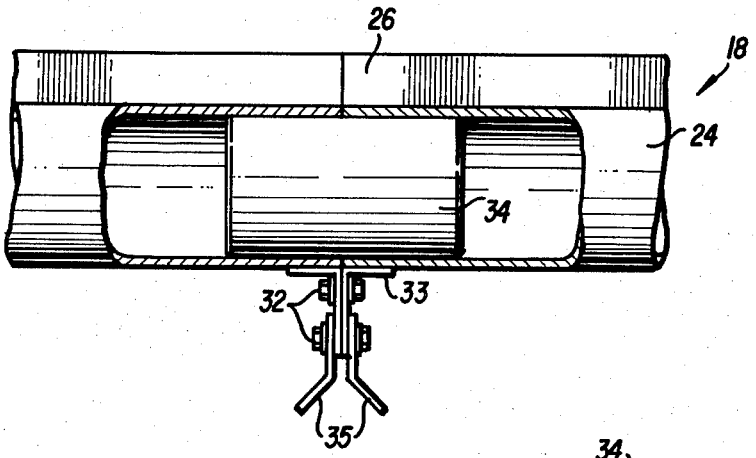
FIGS. 4 and 5 are sectional elevations showing the manner in which sections of the track are joined to each other.
Figure 5:
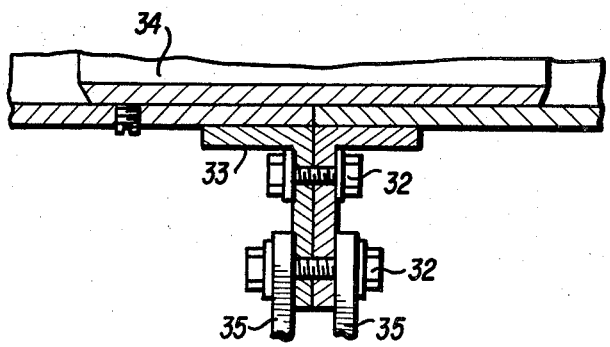

FIGS. 4 and 5 illustrate how the rail sections are joined to form a continuous track. Adjacent sections of tubular rail 24 are attached to each other by longitudinal bolts 32. Alignment of the tube centerline is enforced by a short inner cylinder or dowel 34 the outer diameter of which fits snugly within the inside diameter of tube 24. Mounting lugs 33 and brackets 35 are provided for securing supports 36 to the assembled rail.

As seen in FIG. 3, the monorail track 18 is supported above the ground with adjustable supports 36. The adjustable features are obtained using telescoping struts 38 and 40 which can be used on extremely variable terrain. Crossbrace 42 is provided to form a triangular truss arrangement which gives rigid support preventing transverse movement or longitudinal motion of the track 18. Details of the preferred support structure comprising telescoping inner and outer struts 38 and 40 respectively secured by lock bolt 39 are shown in FIG. 6. The structure of telescoping crossbraces 42 is similar to that of supports 36. The bottom ends of supports 36 are mounted on pads 41 adapted to rest upon the surface of the terrain. Optional pegs or stakes 37 may be provided to secure pads 41 to the ground. Stakes 37 are not essential, however, because the serpentine configuration of the monorail track 18 lends substantial stability to the installation.

Because the monorail track is elevated above the surface of the terrain and pads 41 engage only comparatively small areas of the ground, it will be appreciated that an absolute minimum of alteration to the surface of the terrain is necessary to install the track. This, of course, helps keep down the expense of installing the system as a complete roadway need not be constructed and maintained.

When constructed in this way, the monorail track 18 requires an absolute minimum of maintenance in distinct contrast to prior art mountain slides.

Figure 9:
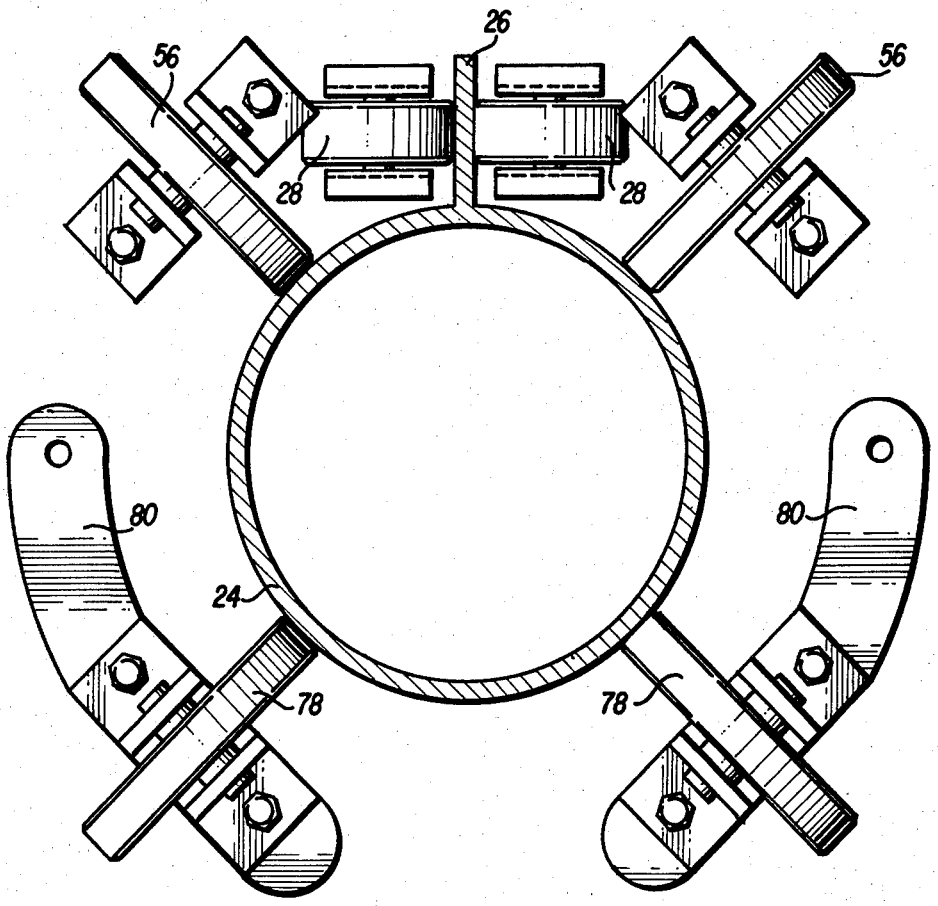
FIG. 9 is a schematic elevation showing the relative positions of the running wheels, guide wheels and safety wheel.

The car body 22 illustrated in FIGS. 2 and 8 is a shell formed from strong lightweight plastic using standard molding techniques. Typical car body skin thickness varies from 3/16 to $\frac{3}{8}$ inches. Car provides a passenger carrying space 44 comprising seat 46 and leg rest space 48 for the rider. Seat belts (not shown) may be provided to secure the rider to the seat 46. As shown in FIG. 8, fore and aft of passenger carrying space 44 are bulkheads 50 and 52, respectively, which are attached to the inside of the car body and which provide means for supporting the wheel means which ride on the rail, the braking system and means for engaging the guide means to achieve angular stabilization. The wheel means comprise a first pair of running wheels 56 at the front of the vehicle and a second pair of running wheels 56 at the rear of the vehicle; the wheels of each pair straddling the guide rib 26 as shown in FIG. 9. Preferably the forward pair of running wheels 56 are toed out from 1 to 4 degrees to increase the running stability of the car by tending to roll outwardly and downwardly along the sides of the tubular track thereby holding the front of the car down and counteracting any tendency for the nose of the car to lift upwardly. It will be appreciated that wheels 56 on the monorail track 18 will give a smooth stable ride.

Positive retention of the vehicle 22 on the monorail track 18 is assured by the provision of at least one safety wheel 78 adapted to engage the underside of the track 18 as shown in FIGS. 8 and 9. In the illustrated embodiment, two safety wheels are provided, one for each pair of running wheels 56. Safety wheels 78 may be adjusted to have a small clearance so that they do not normally contact the track 18 but will engage the underside of the track when running wheels 56 are lifted slightly from the track thereby keeping the vehicle 22 from jumping the track. If desired, each safety wheel can be mounted on a pivotable arm 80 which can be unlocked and swung away so that vehicle 22 can be lifted from the track for maintenance.

Use of a monorail track upon which the vehicle is positively retained enables speeds up to 25 m.p.h. or more to be safely reached. This is three to four times as fast as is safely possible on prior art slides.

Rotational stabilization of vehicle 22 on monorail track 18 is achieved by pairs of opposed guide wheels or rollers 28 which are mounted on bulkheads 50 and 52 such that rollers 28 engage guide rib 26 between them as illustrated in FIGS. 8 and 9. If desired, rollers 28 may be resiliently mounted to provide for a smoother ride. On straight sections of track, guide rib 26 extends vertically upwardly from the top of the tubular portion 24 and guide rollers 28 act to maintain vehicle 22 upright. On curved portions of the track, guide rib 26 is displaced toward the inside of the curve. Guide rollers 28 follow the displaced guide rib and cause the vehicle to bank appropriately for the turn. The proper degree of displacement of the guide rib and the consequent degree of banking of the vehicle depends on the radius of the curve and the speed of the vehicle and is readily calculable by one skilled in the art according to fundamental physical principles.

Figure 10:
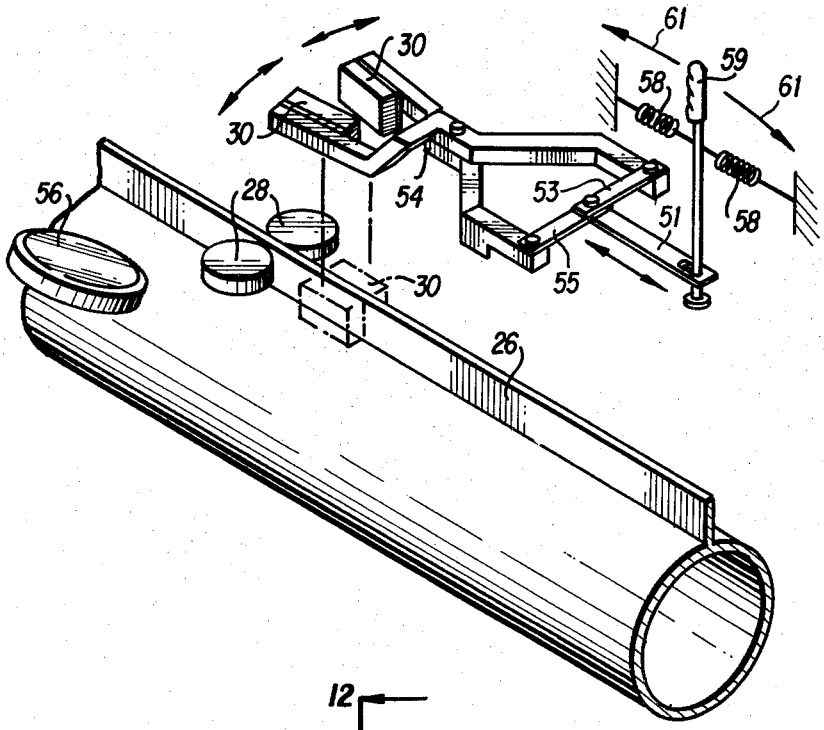
FIG. 10 is a schematic detail of the passenger operated brake.
Figure 11:
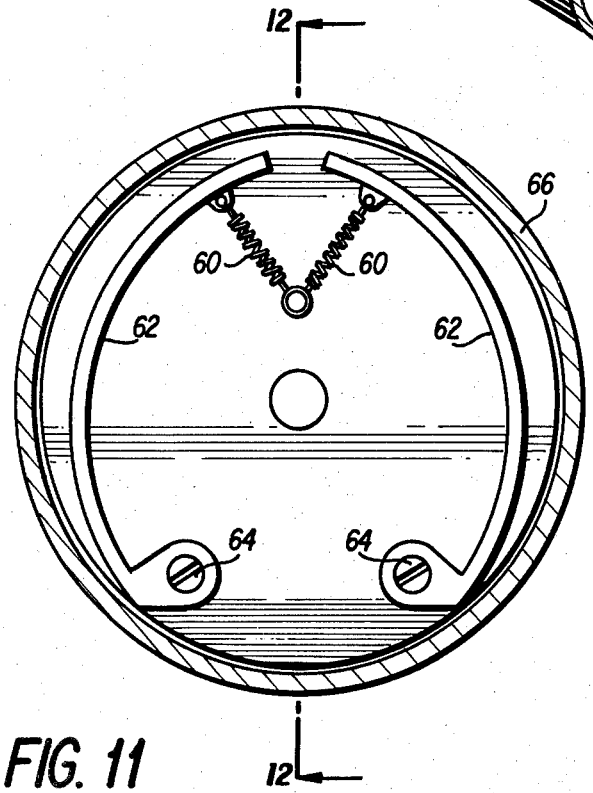
FIGS. 11 and 12 are sectional elevations of the automatic brake means for controlling maximum speed of the vehicle.
Figure 12:
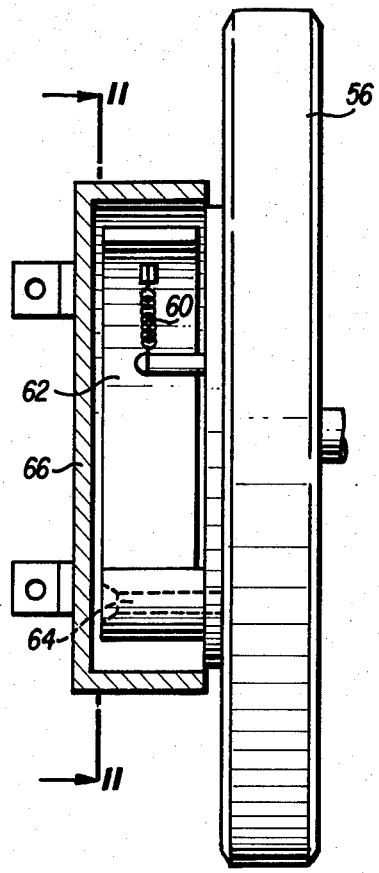

The main braking system is illustrated in FIG. 10 and is a caliper type of brake 54 which pinches the guideway rib 26. In the illustrated embodiment, a brake control handle 59 is connected to caliper 54 by links 51, 53 and 55. The vehicle brakes are activated by the passenger by moving the control handle either forward or backward as indicated by arrows 61 so that the rib 26 is gripped between the opposing brake shoes 30 connected to the arms of caliper 54. Because rib 26 is rigidly attached to the rail, there are no skidding limitations on the braking action. Moreover, because the rail is positively gripped between a movable brake shoe and a cooperating member (the other brake shoe), the maximum braking action is limited only by the force applied by the passenger and not by the weight of the passenger and vehicle. Use of the caliper shoe and rib brake design also provides a brake system subject to a minimum amount of fade and slippage, even when the rail is damp, and enables use of the slide in all types of weather. The brakes are activated whether the brake control handle 59 is moved fore or aft from the neutral or mid-position. Because of the geometry of the brake control a minimum of "hands off" braking is provided which is only released by the rider's action. Springs 58 are provided to bias the brake lever 59 in the neutral position. Means can also be provided to selectively lock the lever in the force or aft position to provide a releasable parking brake for the vehicle. The automatic braking system which limits the maximum speed of the car is activated by centrifugal force as shown in FIGS. 11 and 12. The spring tension of springs 60 prevents braking action at low speeds. When a certain specified speed is reached, centrifugal force on the brake shoes 62 exceeds the spring tension and the rotating brake shoes pivot outwardly around mounting bolts 64 and engage the stationary brake drum 66. Once initiated, the braking action can be amplified using self-energizing brake design if desired. The speed at which the braking action begins is adjusted by changes in the spring tension.

If desired, certain sections of the guideway can have a lower maximum speed limit. This can be accomplished using a second centrifugal brake/wheel assembly which normally is displaced a small distance from the monorail 18. At locations where a lower speed limit is desired, a raised section is attached to the rail 18 which engages the brake wheel thus providing maximum speed control in a limited region.

Figure 13:
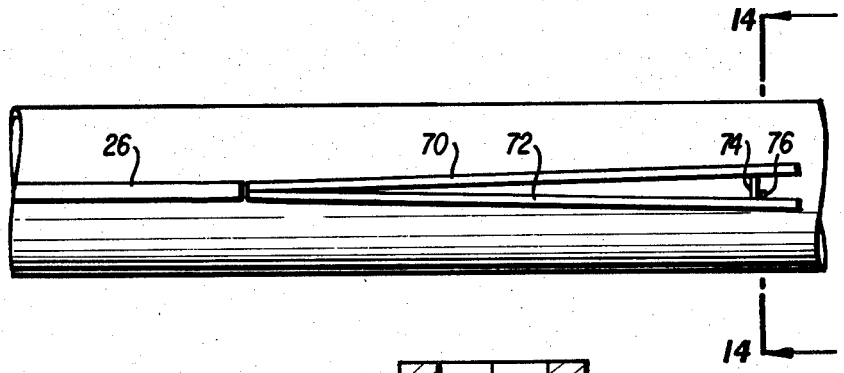
FIG. 13 is a top plan view and FIG. 14 is a sectional elevation of remotely operable means for restraining the movement of a vehicle along the monorail track.
Figure 14:
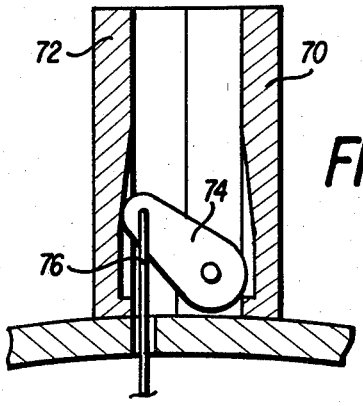

At the bottom of the track, rib 26 is split into expansible sections 70 and 72 as shown in FIGS. 13 and 14. Provision is made for pneumatic or mechanical expanding of the width of the (split) rib thus engaging the main braking system and/or jamming the guide wheels 28 so that all cars would be stopped automatically. A preferred means for expanding the rib is an excentric mechanical cam 74 operated by a suitable hydraulic or electrical actuating mechanism (not shown) via a connecting rod 76. When the lift operator wishes to move the cars along, he collapses the rib back to its original width thus permitting the cars 22 to move to the end of the track and be removed. A similar restraining system can be used at the top of the track to facilitate rider loading.

The foregoing embodiment has been described solely for purposes of exemplification and not by way of limitation. Accordingly, the scope of the invention is to be limited solely by the scope of the appended claims.

We claim:

1. An amusement ride comprising a single continuous track having a tubular body with a circular cross section adapted to be disposed on nonlevel terrain to form a descending tortuous path; means for supporting said track in spaced relation to the underlying terrain; at least one gravity vehicle comprising a passenger-carrying space and having front and rear pairs of running wheels riding directly on said tubular track body; said front pair of wheels being toed out between one and four degrees; the center of gravity of said vehicle lying above the center of said tubular track body; said vehicle further comprising means for retaining said vehicle on said track and passenger-actuated brake means for selectively gripping a portion of said track between a movable brake shoe and an opposing member to control the speed of said vehicle along said track; said ride further comprising means for positively controlling the rotational orientation of said vehicle on said track including a continuous longitudinal rib extending radially outwardly from said tubular track body; and means on said vehicle for continuously engaging the opposite sides of said rib.

2. A ride as recited in claim 1 wherein said track comprises curved portions, and said means for controlling rotational orientation of said vehicle is displaced on said curved portions to positively bank said vehicle as it traverses said curved portions.

3. A ride as recited in claim 1 wherein said means for supporting said track comprises telescoping supports and cross braces.

4. A ride as recited in claim 1 wherein said rib engaging means comprises at least one pair of opposed rollers fixedly mounted on said vehicle.

5. A ride as recited in claim 1 wherein said retaining means comprises at least one safety wheel on said vehicle spaced from the underside of said track and positioned to engage the underside of said track when said supporting wheels are lifted from said track.

6. A ride as recited in claim 1 wherein said passenger-controlled brake means comprises double-acting lever means operatively connected to opposed brake shoes adapted to grip said rib therebetween when said lever means is moved either forward or backward away from a neutral position.

7. A ride as recited in claim 6 wherein said lever means is spring biased to said neutral position.

8. A ride as recited in claim 1 further comprising means for automatically braking said vehicle when a predetermined speed is exceeded.

9. A ride as recited in claim 8 wherein said automatic brake means comprises a pair of rotating opposed brake shoes movably mounted on said wheel means and a cooperating drum mounted on said vehicle such that when the angular velocity of said wheel means reaches a predetermined value, the centrifugal forces acting on said brake shoes causes said brake shoes to move outwardly into engagement with said cooperating drum.

10. A ride according to claim 1, wherein said passenger-actuated brake means on said vehicle comprises a pair of opposed brake shoes disposed in spaced relation on opposite sides of said continuous rib on said track; said track further comprising remotely operable means for selectively expanding the rib on a portion of the track into engagement with the brake shoes of a vehicle traversing that portion of the track whereby the movement of the vehicle is restrained.

11. A ride according to claim 1, wherein said toed-out running wheels rotate about non-horizontal axes.

* * * * *